US008136316B2

(12) United States Patent
Schwarz et al.

(10) Patent No.: US 8,136,316 B2
(45) Date of Patent: Mar. 20, 2012

(54) ROOF AND WALL COVERING WITH IMPROVED CORNER CONSTRUCTION

(75) Inventors: Stefan Helmut Schwarz, Coral Springs, FL (US); Robert Trabue, Hollywood, FL (US)

(73) Assignee: Exteria Building Products, LLC, Miami, FL (US)

( * ) Notice: Subject to any disclaimer, the term of this patent is extended or adjusted under 35 U.S.C. 154(b) by 0 days.

(21) Appl. No.: 12/511,601

(22) Filed: Jul. 29, 2009

(65) Prior Publication Data

US 2010/0011690 A1 Jan. 21, 2010

Related U.S. Application Data

(63) Continuation-in-part of application No. 11/702,256, filed on Feb. 5, 2007, now Pat. No. 7,735,286.

(51) Int. Cl.
*E04D 1/00* (2006.01)
*E04B 2/00* (2006.01)
*E04B 1/00* (2006.01)

(52) U.S. Cl. ..... 52/288.1; 52/287.1; 52/748.1; 52/506.1; 52/518; 52/555; 52/520

(58) Field of Classification Search ..... 52/531, 52/520, 521, 528, 518, 506.01, 302.1, 287.1, 52/530, 288.1, 539, 555, 747.1, 314, 748.1, 52/748.11, 557, 276
See application file for complete search history.

(56) References Cited

U.S. PATENT DOCUMENTS

| | | | | | |
|---|---|---|---|---|---|
| 1,664,463 | A | * | 4/1928 | Muryn | 52/278 |
| 2,616,131 | A | * | 11/1952 | Gage | 52/276 |
| 2,849,757 | A | * | 9/1958 | Meldrum | 52/276 |
| 3,289,380 | A | * | 12/1966 | Charniga, Jr. | 52/717.06 |
| 3,621,625 | A | * | 11/1971 | Medow | 52/314 |
| 3,651,610 | A | * | 3/1972 | Donahue | 52/278 |
| 3,977,141 | A | * | 8/1976 | Peters | 52/313 |
| 4,015,391 | A | * | 4/1977 | Epstein et al. | 52/520 |
| 5,347,784 | A | * | 9/1994 | Crick et al. | 52/520 |
| 5,537,792 | A | * | 7/1996 | Moliere | 52/531 |
| 5,836,123 | A | * | 11/1998 | Gulino | 52/288.1 |
| 6,253,512 | B1 | * | 7/2001 | Thompson et al. | 52/311.1 |
| 6,684,587 | B2 | * | 2/2004 | Shaw et al. | 52/288.1 |
| 6,955,019 | B2 | * | 10/2005 | Donlin et al. | 52/520 |
| 7,127,869 | B2 | * | 10/2006 | Perry | 52/747.1 |
| 7,228,665 | B2 | * | 6/2007 | Perry | 52/287.1 |
| 7,587,871 | B2 | * | 9/2009 | Perry | 52/539 |
| 7,596,919 | B1 | * | 10/2009 | Vande Hey et al. | 52/533 |
| 2005/0102946 | A1 | * | 5/2005 | Stucky et al. | 52/518 |
| 2005/0262784 | A1 | * | 12/2005 | Justice | 52/287.1 |
| 2006/0059830 | A1 | * | 3/2006 | Perry | 52/518 |
| 2008/0098683 | A1 | * | 5/2008 | Trabue et al. | 52/520 |

* cited by examiner

*Primary Examiner* — Robert Canfield
*Assistant Examiner* — Babajide Demuren
(74) *Attorney, Agent, or Firm* — Drinker Biddle & Reath LLP

(57) ABSTRACT

A plastic molded wall covering that includes a plurality of one piece plastic molded corner moldings mounted in a vertically stacked array. The corner moldings each have a pair of front panels disposed at an angle to each other and formed with simulated building elements, such as hand laid stone. The corner moldings have respective upper and lower interlock devices and internal support and reinforcing walls extending rearwardly of the front panels in interconnecting relation to the interlock devices. The internal support and reinforcing walls have a curved serpentine configuration with a curved junction line with the respective front panels such that any plastic molded sink mark exposed on a front side of the front panels from the integrally formed internal walls similarly is undulating so as to blend into the simulated building elements and not detract from its natural appearance.

18 Claims, 4 Drawing Sheets

25
6
29a
29
28
28
28
32a
32
32a
31a
31a
31
12
18
45
47
48
46
49
49
48
18
48b
50
20
49
49
20a
48a
20
49
49
20a
50
49
49
16
16
49
39
34
26
40
35
38
40
41
6

ROOF AND WALL COVERING WITH IMPROVED CORNER CONSTRUCTION

RELATED APPLICATION

The present application is a continuation-in-part of application Ser. No. 11/702,256 filed Feb. 2, 2007, the disclosure of which is incorporated herein by reference.

FIELD OF THE INVENTION

The present invention relates generally to roof and wall coverings comprised of relatively large panels which each are molded or otherwise formed with decorative patterns characteristic of conventional roofing and siding materials such as stone, brick, shake, tile, or the like, and more particularly, to a corner construction for such wall or roof coverings.

BACKGROUND OF THE INVENTION

Various synthetic wall and roof coverings are known today, such as those formed of elongated molded thermoplastic wall panels that are nailed or screwed to a wall or roof support surface in horizontal courses or rows in partially overlapping relation to each other so as to provide a substantially water resistant, protective layer over the support surface. Such panels, which usually are identically molded, commonly are formed with one or more rows of simulated building elements, such as stone, brick, or shake shingles. Since the panels are identically molded, a panel-to-panel identity can be easily noticed if the panels are not carefully installed. Installation problems particularly occur when installing such synthetic wall and roof coverings about corners of the roof or sidewalls.

Typically, corner moldings are used to join the wall panels at corners of the wall surfaces. In some prior corner moldings, the wall panels must be positioned into abutting relation with a pre-mounted corner molding prior to installation of the wall panel. Such mounting requires precise cutting of the ends of the panels to ensure good installation, which can substantially increase the time and cost of installation. In other known corner moldings, an end of the wall panel is positioned into a side cavity of the corner molding, which can leave unsightly gaps between the corner molding and wall panel by virtue of excessive tolerances.

The continuing need exists for improving the structural integrity of such corner moldings for enhancing efficient and reliable installation of the corner construction for long-term usage. While it is desirable to provide internal vertical support and reinforcing walls that extend inwardly of the front faces of such corner moldings, a problem with such internal walls or reinforcing flanges in plastic injection molded parts is that they can create sink marks on the exposed outer faces of the corner molding due to non-uniform cooling of the molded plastic material at the juncture between the mating walls. Vertical sink marks are a particular problem with corner moldings which have horizontally disposed building elements, typical of simulated hand laid stone or brick. In that case, unlike vertically-oriented cedar shake and the like, the sink marks noticeably cross perpendicularly to the horizontally-oriented building elements.

OBJECTS AND SUMMARY OF THE INVENTION

It is an object of the present invention to provide a wall covering having corner moldings that facilitate more reliable installation and which are adapted for long-term usage.

Another object is to provide a corner molding of the foregoing type which permits efficient mounting of the corner moldings after installation of the wall panels.

A further object is to provide a corner molding as characterized above which has internal vertical reinforcing and mounting wall structures without noticeable sink marks on the exposed outer faces of the corner molding building elements that detract from the natural and aesthetic appearance of the corner construction.

Still another object is to provide a corner molding of the above kind which has horizontally-oriented simulated building elements, such as simulated hand laid stone or brick, in which sink marks from internal reinforcing and mounting wall structures blend into the outer appearance of the corner molding in a manner that is substantially unnoticeable.

Other objects and advantages of the invention will become apparent upon reading the following detailed description and upon reference to the drawings, in which:

DETAILED DESCRIPTION OF THE INVENTION

Figure 1:
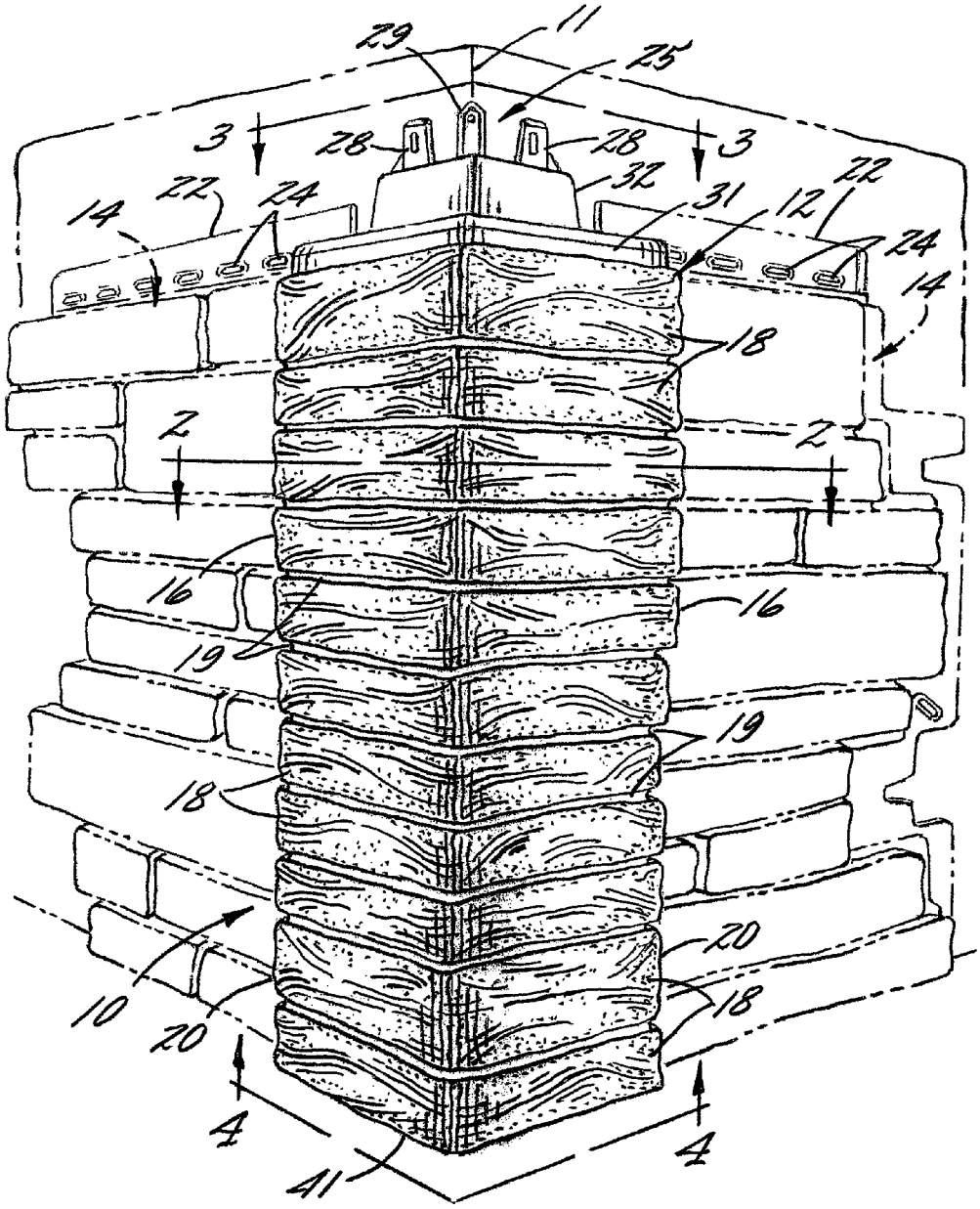
FIG. 1 is a perspective of a corner wall covering construction having corner moldings in accordance with the invention.
Figure 2:
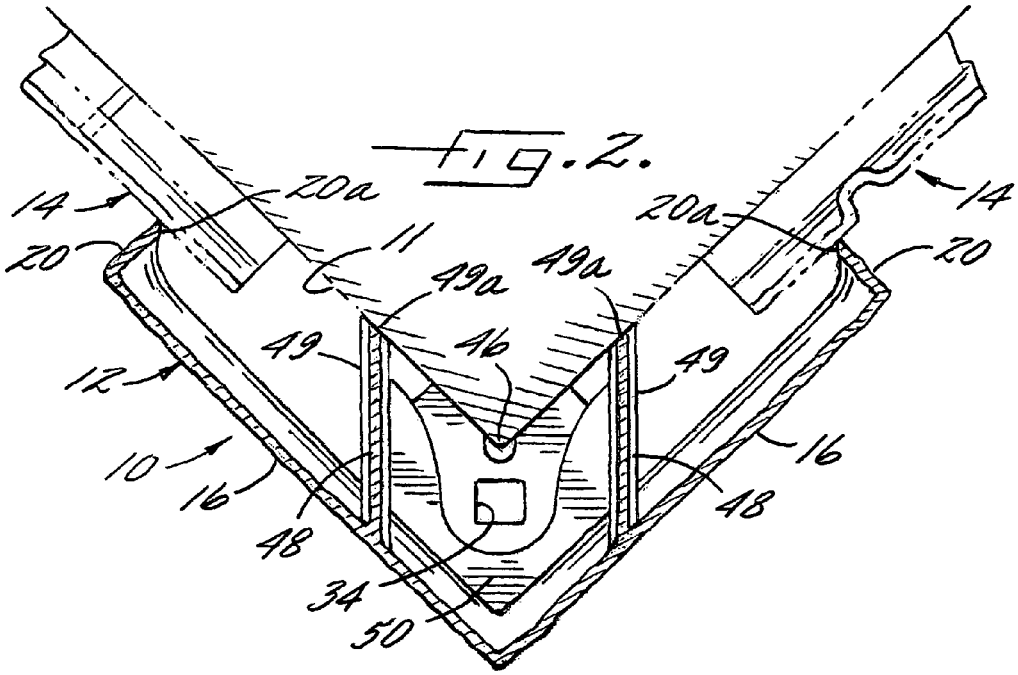
FIGS. 2-4 are enlarged fragmentary sections of the corner moldings taken in the planes of lines 2-2, 3-3, and 4-4, respectively, in FIG. 1.
Figure 3:
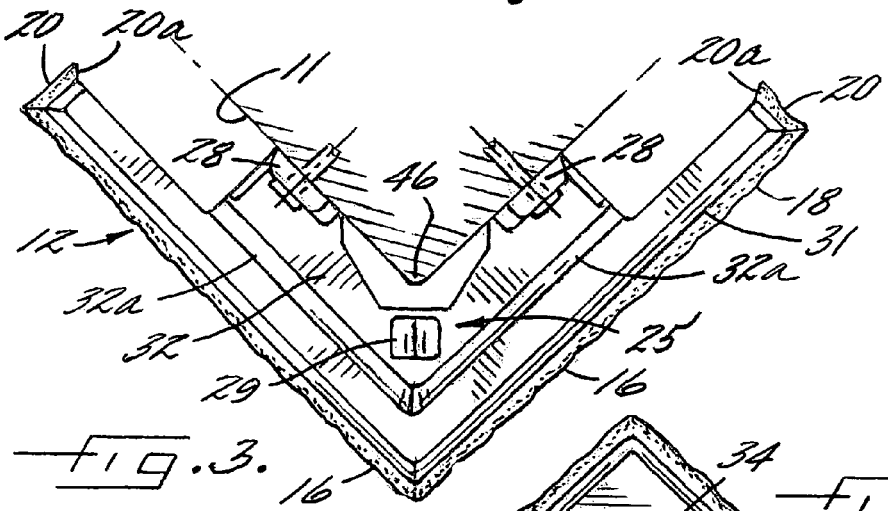
Figure 4:
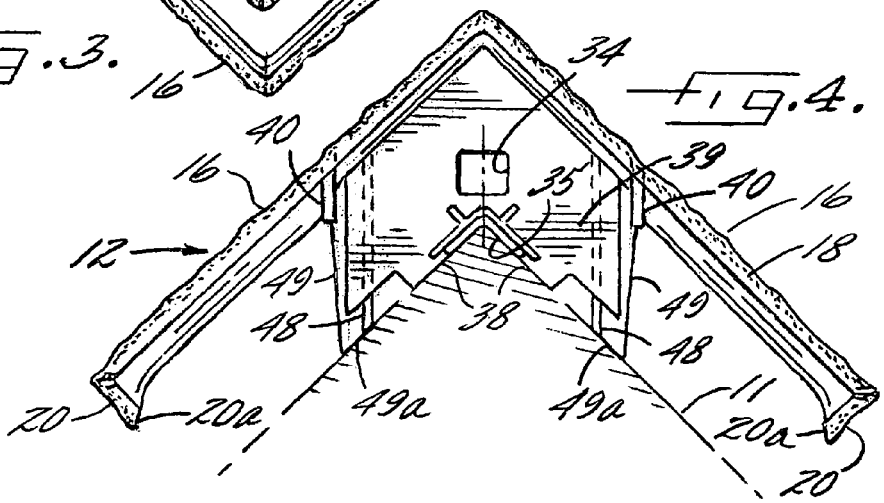
Figure 5:
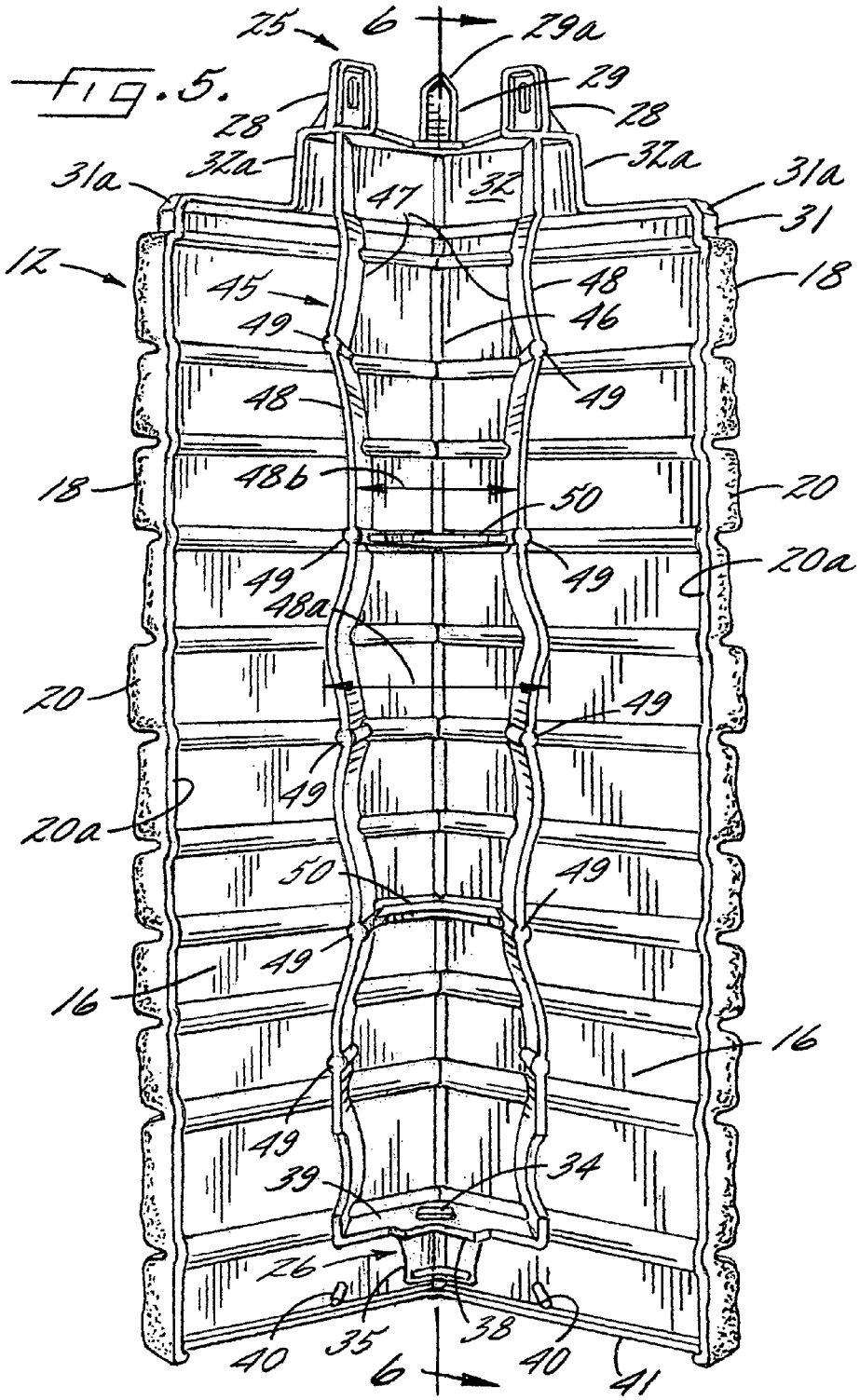
FIG. 5 is a rear perspective of the corner moldings of the corner construction shown in FIG. 1.
Figure 6:
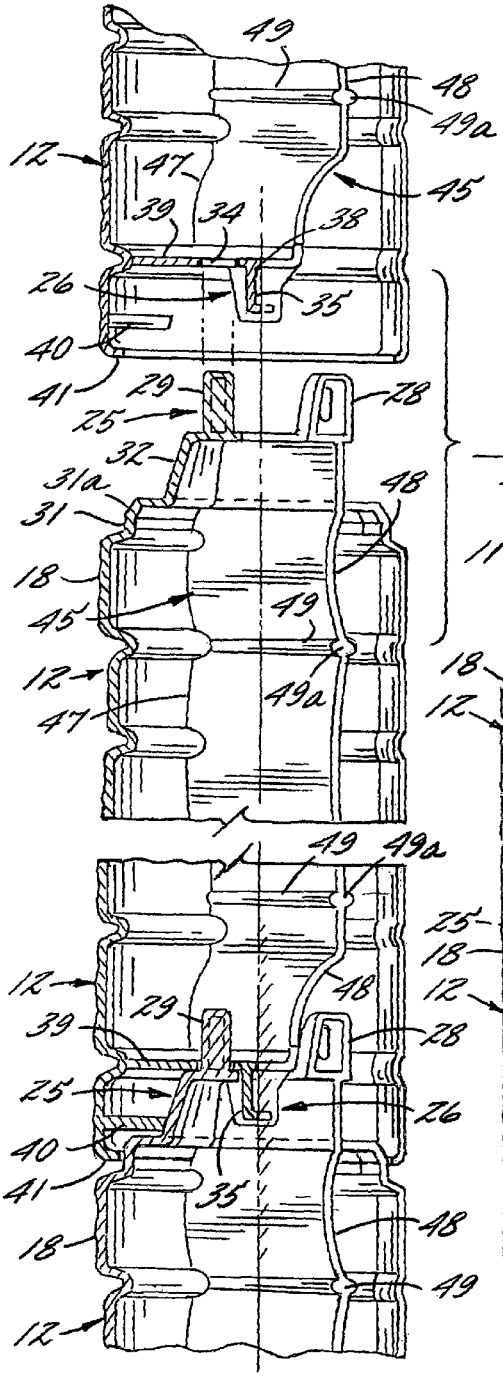
FIG. 6 is an exploded fragmentary section of the corner moldings of the illustrated corner construction, taken in the plane of line 6-6 in FIG. 5.
Figure 7:
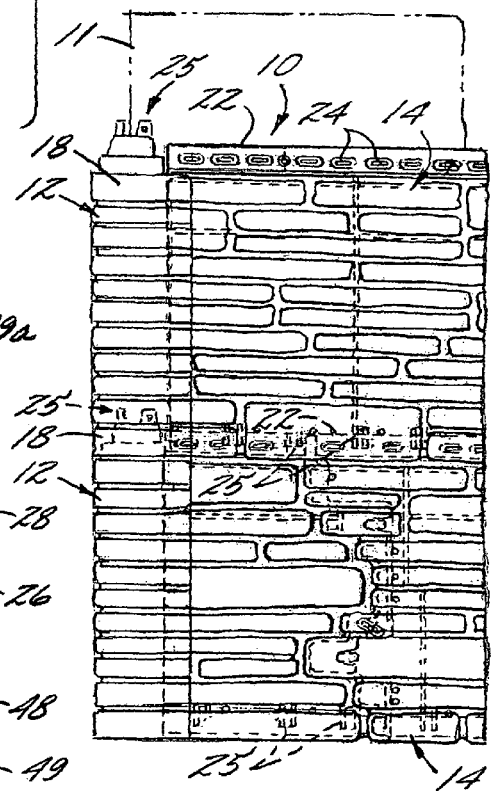
FIG. 7 is a partial side view of the corner construction shown in FIG. 1.

Referring now more particularly to the drawings, there is shown an illustrative wall covering 10 in accordance with the invention mounted about a corner of sidewall surfaces 11 of a building structure. The wall surfaces 11 in this case are at a right angle to each other typical of the exterior corner of a building. The wall covering 10 comprises a plurality of corner moldings 12 mounted in vertically or stacked relation to each other and a plurality of wall panels 14 mounted laterally to each side of the corner moldings 12.

The wall panels 14 may be of a type, such as shown in application Ser. No. 12/511,623 filed simultaneously with the present application, the disclosure of which is incorporated herein by reference. The wall panels 14, which preferably are molded out of relatively thin rigid plastic material, each are formed with simulated building elements, which in this case are in the form of rows of simulated horizontally oriented stone 18 typical of hand laid stone masonry.

The corner moldings 12, which also are plastic injection molded, have front panels 16 disposed at a right angle to each other, which in this case are formed with simulated stone 18 in vertically stacked relation to each other separated by horizontal mortar lines 19. The stone 18 protrudes outwardly of the mortar lines 19, typical of hand laid stone, and have irregular outer surfaces consistent with natural stone. Peripheral rearwardly extending vertical sides 20 of the front panels 16 define ends of the simulated stone and rigidify the sides of the corner molding. While the invention has particular utility in corner molding and panels formed with simulated masonry, such as hand laid stone or brick, it will be understood that other forms of simulated building elements could be used, such as shake shingles, tile, or the like.

The corner moldings 12 are designed to permit efficient unencumbered mounting of the wall panels 14 on the wall surfaces 11 prior to mounting of the corner moldings 12. As is known in the art, the wall panels 14 typically are mounted on the support surfaces 11 of the building wall or roof structure in horizontal courses, beginning with the lower most course, with the left and right side marginal edge regions in overlying relation to each other and with the lower marginal edge region of the wall panels 14 in each course overlying the upper marginal edge region of the wall panel in the course immediately below.

For securing the wall panels 14 to the wall surfaces 11, an upper marginal edge mounting flange 22 of each wall panel 14 is formed with a row of elongated laterally spaced fastener receiving apertures 24. The lower marginal edge region of each panel in this case is formed with a plurality of rearwardly and downwardly directed interlock flanges 25 that are engageable with the upper marginal edge mounting flange 22 of the previously mounted panel that is supported in elevated relation to the wall surface 11. It will be understood that the overlapping right and left side marginal edge regions of the panels also may be formed with appropriate interlock means, such as disclosed in the aforereferenced simultaneously filed application.

For facilitating positioning and mounting of the corner moldings 12 in predetermined stacked relation to each other and to the previously installed wall panels 14, each corner molding 12 has a mounting and interlock mechanism 25 that extends rearwardly and upwardly of the upper marginal edge region of the stone 18 for cooperation with an interlock member 26 adjacent a lower end of the corner molding 12. The mounting and interlock mechanism 25 in this case includes a pair of mounting flanges 28 disposed in right angle planes to each other and an upwardly extending latch and alignment pin 29. The mounting flanges 28 and latch and alignment pin 29 are supported by an upright structure comprising a right angle wall 31 extending upwardly from the uppermost simulated stone 18 of the corner molding 12, and a right angle support structure 32 extending upwardly in recessed relation to the right angle wall 31. The latch and alignment pin 29 extends upwardly from a corner or apex of the right angle support structure 32 for interlocking engagement with an interlock and alignment aperture 34 in the lower interlock member 26 of the next corner molding 12 in the vertical array. The lower interlock member 26 in this case is a horizontal plate 39 extending rearwardly of the corner molding front panels 16 formed with the interlock and receiving aperture 34.

The interlock and alignment mechanism 25 is designed to both align the corner molding 12 in relation to a previously mounted corner molding 12 and to positively retain the corner molding 12 in engaging relation with the building elements of the adjacent wall panels 14. For this purpose, the upstanding latch pin 29 and interlock aperture 34 have rectangular cross sections and the lower transverse interlock member 26 has a depending right angle flange 35 having side walls that engage and align with corresponding angled walls 38 formed in an upper transverse plate 39 of the support structure 32. For facilitating interengagement and alignment of the corner panels 12 during installation, the latch and alignment pin 29 has an tapered upper end 29*a*, and the upright support structure 32 has inwardly tapered side walls 32*a*. An upper portion 31*a* of the right angle support wall 31 is also tapered. Frangible pins 40 extend rearwardly of the front corner molding panels 16 for locating the corner molding 12 in predetermined relation with previously mounted corner molding while allowing for temperature expansion and contraction. Hence, such interlock and locating means allows for easy and reliable aligned interengagement of one corner molding in stacked relation onto the previously mounted corner molding, with a lower peripheral edge 41 of the corner molding 12 in closely spaced relation to the uppermost simulated stone 18 of the previously mounted corner molding without unsightly gaps between the simulated stone of the vertically adjacent corner moldings.

In accordance with a further important aspect of the invention, each corner molding has an internal wall structure that facilitates mounting about the corner wall surfaces and rigidifies the construction of the corner molding without molding sink marks on exposed faces of the simulated building elements that distract from the natural appearance of the simulated building elements. To this end, each corner molding 12 has integrally formed vertical support and reinforcing walls 45 that extend vertically substantially the length of the corner molding for both rigidifying its construction and facilitating its mounting about the corner wall surfaces 11. The reinforcing and support walls 45 in this case are located intermediate an apex 46 and peripheral sides 20 of the corner molding panels 16 and extend between and interconnect the upper interlock mechanism 25 and the lower interlock member 26. As can be seen, such vertically extending support and reinforcement walls 45 extend in substantially transverse relation to the horizontally oriented simulated stone 18 of the corner molding 12.

In carrying out the invention, the support and reinforcing walls 48 have a curved undulating configuration such that any plastic injection molding sink marks that may occur on a front face of the corner molding 12 is similarly undulating so as to blend into the simulated stone and not to detract from its natural appearance. The reinforcing and support walls 48 in this case are serpentine configured with peaks 48*a* and valleys 48*b* of the walls 48 disposed in opposed relation to each other. The junctures 47 of the walls 48 with the rear sides of the front panels 14 are similarly undulating. For further rigidifying the wall structure, the walls 48 are formed with longitudinally spaced rigidifying ribs 49, which in this case have a rounded configuration, and a pair of horizontal reinforcing flanges 50 interconnect between the inside apex area of the corner molding 12 and the reinforcing and support walls 48.

In further carrying out this feature of the invention, the support and reinforcing walls 48 are formed with respective co-planar mounting surfaces 49*a* that are oriented in perpendicular relation to each other for greater area contacting engagement with the wall mounting surfaces 11. The co-planar mounting surfaces 49*a* in this case include ends of reinforcing ribs 49. In the illustrated embodiment, the rearward edges of the corner side 20 also are formed with tapered surfaces 20*a* for overlapping engagement with the wall panels 14.

From the foregoing, it can be seen that the corner moldings of the present invention have both a rigid construction and facilitate aligned interlocking vertically stacked mounting. While the internal reinforcing and support walls extend vertically the substantial length of the corner moldings in substantially transverse relation to the simulated stone of the corner molding, any plastic injection molding sink marks that may occur on the exposed outer faces of the corner molding tend to blend into the simulated stone in a manner that does not detract from the natural and aesthetic appearance of the simulated stone.

The invention claimed is:

1. A plastic molded wall covering for a pair of wall surfaces that form a corner comprising:

a plurality of one piece plastic molded elongated wall panels each formed with a plurality of simulated building elements, said wall panels being mounted on said wall surfaces in a plurality of horizontal courses with side marginal edge regions of adjacent panels in overlying relation to each other and with a lower marginal edge region of each wall panel in partially overlying relation to an upper marginal edge region of a previously mounted course of said wall panels, a plurality of one piece plastic molded corner moldings in a vertically stacked arrangement each laterally adjoining the wall panels of horizontally adjacent courses, said corner moldings having a pair of front panels disposed at an angle to each other corresponding substantially to the angle of the wall surfaces that define the corner upon which the corner molding is mounted, said corner molding front panels each being formed with simulated building elements, at least two internal walls, each internal wall being integral with an extending rearwardly of a respective one of said front panels at a location intermediate opposite sides of the front panel, and each internal wall joining a rear side of said front panel with a curved juncture line such that any plastic molded sink mark exposed on a front side of said front panel from said integrally formed internal wall does not extend in a straight line in which said walls each have a curved undulating configuration which define a curved undulating junction line with the corner molding panel from which it depends.

2. The plastic molded wall covering of claim 1 in which said side walls are formed with respective mounting surfaces for engaging said corner wall surfaces upon mounting.

3. The plastic molded wall covering of claim 1 in which corner moldings are mounted on the corner of said wall surfaces with the building elements of said front panels in partially overlying relation to the wall panels of horizontally adjacent courses.

4. A one piece plastic molded corner molding for a wall covering mountable on two wall surfaces that form a corner and which includes a plurality of laterally adjacent wall panels each formed with simulated building elements, said corner molding comprising a pair of front panels disposed at an angle to each other corresponding substantially to the angle of the wall surfaces that define the corner upon which the corner molding is mountable, said front panels being formed with horizontally oriented simulated building elements, a pair of internal walls each being integral with and extending rearwardly of a respective one of said corner molding front panels, said internal walls each extending transversely to said horizontally oriented simulated building elements, and said internal walls each joining a rear side of the respective front panel with a curved juncture line such that any plastic molding sink marks exposed on a front side of said front panels from said integrally formed internal walls does not extend in a straight line in which said internal walls each join a rear side of the respective front panel with a curved undulating juncture line.

5. A plastic molded wall covering for a pair of wall surfaces that form a corner comprising:

a plurality of one piece plastic molded elongated wall panels each formed with a plurality of simulated building elements, said wall panels being mounted on said wall surfaces in a plurality of horizontal courses with side marginal edge regions of adjacent panels in overlying relation to each other and with a lower marginal edge region of each wall panel in partially overlying relation to an upper marginal edge region of a previously mounted course of said wall panels, a plurality of one piece plastic molded corner moldings in vertically stacked arrangement each laterally adjoining the wall panels of horizontally adjacent courses, said corner moldings having a pair of front panels disposed at an angle to each other corresponding substantially to the angle of the wall surfaces that define the corner upon which the corner molding is mounted, said corner molding front panels each being formed with simulated building elements and being mounted in overlying relation to an adjacent wall panel, said corner moldings each having an upper interlock device adjacent an upper end of said corner molding and a lower interlock device adjacent a lower end of said corner molding for interlocking engagement with an upper interlock member of an underlying previously mounted corner molding in the vertically stacked arrangement, said upper interlock device including an upstanding interlock pin, said lower interlock device including an interlock pin receiving aperture for receiving the interlock pin of an underlying corner molding in the stacked arrangement, and said upper and lower interlock devices having engageable alignment surfaces for aligning the corner moldings in stacked relation to each other as an incident to mounting, wherein said corner moldings include frangible locating pins extending rearwardly of said corner molding panels adjacent a lower end thereof for locating the corner moldings in vertically stacked relation to each other as an incident to mounting.

6. The plastic molded wall covering of claim 5 in which said interlock pin and interlock aperture have complementary non-circular configurations for aligning the corner moldings in aligned relation to each other as an incident to mounting.

7. The plastic molded wall covering of claim 5 in which said upper interlock device includes a V-shaped upright mounting structure having inwardly tapered side walls for guiding the corner moldings into aligned relation to each other as an incident to mounting.

8. The plastic molded wall covering of claim 5 in which said upper interlock device includes a transverse plate with an opening defining locating surfaces, and said lower interlock device includes a depending alignment and locating member positionable into mating relation to the locating surfaces of the upper interlock device as an incident to mounting in the stacked arrangement.

9. The plastic molded wall covering of claim 1 in which said corner molding front panels are formed with simulating building elements that extend substantially horizontally, and said at least one internal wall is oriented transversely to the horizontal direction of said building elements.

10. The plastic molded wall covering of claim 1 in which said walls are curved in a serpentine configuration.

11. The plastic molded wall covering of claim 1 in which said internal walls have integrally formed reinforcing ribs at spaced locations.

12. The plastic molded wall covering of claim 1 including a plurality of transverse reinforcing flanges interconnecting said internal walls and rear sides of said front panels.

13. The plastic molded wall covering of claim 1 in which said corner molding has an upper interlock device adjacent an upper end of said corner molding and a lower interlock device adjacent a lower end of said corner molding for interlocking engagement with the upper interlock device of an underlying previously mounted corner molding in the vertically stacked arrangement, and said internal walls extending between said interlock devices.

14. The one piece plastic molded corner molding of claim 4 in which said building elements are in the form of hand laid simulated masonry.

15. The one piece plastic molded corner molding of claim 4 in which said internal walls are curved in a serpentine configuration.

16. The one piece plastic molded corner molding of claim 4 in which said internal walls have integrally formed reinforcing ribs at spaced locations.

17. The one piece plastic molded corner molding of claim 4 including a plurality of transverse reinforcing flanges interconnecting said internal walls and rear sides of said front panels.

18. The one piece plastic molded corner molding of claim 4 in which said corner molding has an upper interlock device adjacent an upper end of said corner molding and a lower interlock device adjacent a lower end of said corner molding for interlocking engagement with the upper interlock device of an underlying previously mounted corner molding in the vertically stacked arrangement, and said internal walls extending between said interlock devices.

* * * * *